US005089324A

United States Patent [19]

Jackson

[11] Patent Number: 5,089,324

[45] Date of Patent: Feb. 18, 1992

[54] PRESS SECTION DEWATERING FABRIC

[75] Inventor: Graham W. Jackson, Carleton Place, Canada

[73] Assignee: JWI Ltd., Kanata, Canada

[21] Appl. No.: 584,096

[22] Filed: Sep. 18, 1990

[51] Int. Cl.[5] ..... B32B 5/02

[52] U.S. Cl. ..... 428/234; 139/383 A; 139/383 AA

[58] Field of Search ..... 139/383 A, 383 AA, 425 A; 162/358, DIG. 1, 348; 428/225, 226, 257, 234

[56] References Cited

U.S. PATENT DOCUMENTS

| | | | |
|---|---|---|---|
| 3,657,068 | 4/1972 | Ivanowicz | 139/383 A |
| 4,290,209 | 9/1981 | Buchanan et al. . | |
| 4,414,263 | 11/1983 | Miller et al. . | |
| 4,438,788 | 3/1984 | Harwood . | |
| 4,565,735 | 1/1986 | Murka . | |
| 4,676,278 | 6/1987 | Dutt . | |
| 4,695,498 | 9/1987 | Sarrazin . | |
| 4,737,241 | 4/1988 | Gulya | 139/383 AA |
| 4,749,007 | 6/1988 | Malmendier | 139/383 A |
| 4,806,208 | 2/1989 | Penven | 139/383 AA |
| 4,847,206 | 9/1989 | Kufferath . | |
| 5,023,132 | 6/1991 | Stanley et al. . | |

FOREIGN PATENT DOCUMENTS

| | | | |
|---|---|---|---|
| 0273892 | 12/1987 | European Pat. Off. | 139/383 A |
| 3426264 | 1/1986 | Fed. Rep. of Germany . | |
| 1362684 | 8/1974 | United Kingdom . | |

*Primary Examiner*—Andrew M. Falik
*Attorney, Agent, or Firm*—Cushman, Darby & Cushman

[57] ABSTRACT

A dewatering fabric for the press section of a paper machine having improved dewatering capabilities. The fabric is constructed to provide long exposed floats of flattened monofilaments on the paper side of the fabric, at a high fill factor. The fabric may be used alone, with a paper side batt, or with a batt on each side.

31 Claims, 5 Drawing Sheets

PRESS SECTION DEWATERING FABRIC

RELATED APPLICATION

This Application is a Continuation-in-Part of Application Ser. No. 07,409,163, filed Sept. 19th, 1989, now abandoned.

This invention relates to dewatering fabrics used in the press section of a paper making machine, and is particularly concerned with such a fabric including flattened monofilaments configured to provide improved water removal and reduced paper marking.

In the press section of a paper making machine a thin, wet, self supporting web of matted paper fibers, having a consistency of from about 15% to about 25% (that is a wet paper web containing from about 15% to about 25% of fibers and other solids and from about 75% to 85% water), is passed though a series of pressure rollers whilst supported on a series of endless belts of permeable felts. In each of the sets of rollers, some of the water in the paper web is transferred to the felt by the action of line nip pressure between the press rolls. At the end of the press section, the wet paper web will have a consistency of from about 30% to about 50%. Generally in the press section pressure rolls are used in pairs. One roll usually is smooth, and may be provided with an elastomeric (typically rubber) surface. The other roll has a contoured surface usually made also of an elastomeric material adapted to provide voids into which water can be transported from the press felt. A roll having a grooved surface wherein the grooves are around the roll and essentially perpendicular to the roll axis is commonly used. The press felt acts as an intermediary between these grooves (or other receptacles, such as perforations) and the wet paper web. As the paper web carried on the felt enters the nip between the press rolls, water is squeezed from the paper web by the smooth roll into the compressed felt and ultimately into the roll grooves. As the felt and wet paper web leave the nip, some of the water remaining in the felt can be transferred back to, and be reabsorbed by, the wet paper web.

Generally, a press felt comprises a combination of a base cloth having needle punched to it a staple fiber batt. In some press felts a single layer of batt is used, needle punched to the paper side of the base cloth. In others, two layers of batt are used, one on each side of the base cloth, to which they are both needle punched. It is known that the batt fibers tend to be aligned in the direction the batt is laid on the base cloth. If the batt is cross lapped, that is, laid essentially in the cross-machine direction, then in addition to the batt fibers being aligned across the machine, a cross lap line exists between successive strips of batt. These join areas can result in mass variations in the press felt which, in extreme cases, can generate vibration effects in the roll stands which will damage the machinery. In more recent practice, the batt can be laid substantially in the machine direction using, for example, the method described by Dilo, in U.S. Pat. No. 3,508,307, which both eliminates the cross-machine mass variations and provides better drainage due to the fiber alignment in the batt being in the machine direction.

The base fabrics of modern press felts can include a pin seam and are typically woven of synthetic, circular cross-section monofilaments as both the warp and weft, as typified by Lilja in U.S. Pat. No. 4,601,785. The machine direction yarns, which form the pin-receiving loops of these felts, must be monofilaments for the loops to retain their shape, thereby ensuring that the fabric may be easily seamed during its installation on the paper making machine. However, it is difficult to reliably needle a batt to a fabric that is woven of all round monofilaments. The needles will tend to deflect the round yarns rather than penetrate them. A machine side batt must then be used to assist adhesion of the paper side batt. A further disadvantage of press felt base fabrics woven of all round monofilaments is that they tend to form prominent knuckles at warp and weft intersection points. A further disadvantage is that the area of contact between warp and weft cross-overs is limited to a point. The fabric is thus susceptible to diagonal distortion or sleaziness.

It has been proposed by Miller et al. in U.S. Pat. No. 4,414,263 to improve the properties of the base cloth, and thereby of the press felt, by incorporating into the base cloth fabric monofilaments of a flattened cross-section. Miller et al. define their improved press felt as "comprising an open-mesh fabric woven of a plurality of synthetic filaments extending in both the lateral and longitudinal directions, and at least one batt of staple fibers needled thereto, characterized in that at least some of the filaments extending in the lateral direction are monofilaments having a flattened cross-section, the long axis of which lies parallel to the plane of the fabric". Miller et al. incorporate these flattened monofilaments into a conventional weave pattern. Miller et al. recommend that the aspect ratio (that is the ratio of width to thickness) should be from 1.2:1 to 3:1, with a value of about 2:1 being preferred, for these flattened monofilaments.

It has also been proposed to use similar flattened monofilaments in a paper maker's forming fabric by both Johnson (U.S. Pat. No. 4,815,499) and Kositzke (U.S. Pat. No. 4,142,557). Although such paper maker's forming fabrics may be superficially similar to those used in the press section, nevertheless they are actually quite different, as is dictated by the conditions under which they are used. Kositzke, for example, is primarily concerned with improving a forming fabric which is woven as a continuous run of flat fabric, and seamed to provide the required loop, and in which the weave pattern used is the four harness satin weave. In order to improve such a forming fabric, Kositzke advocates the use of a flattened monofilament in which the ratio of width to height is of the order of 1.2:1 to 1.3:1. Flat monofilaments have been proposed for dryer fabrics to reduce air permeability (Buchanan et al., U.S. Pat. No. 4,290,209) or to increase surface contact (Malmendier, U.S. Pat. No. 4,621,663). It is also known to extrude such flat monofilaments with contoured surfaces (Langston et al., U.S. Pat. No. 4,643,119).

Flattened monofilaments of this general type have been used in other woven fabrics. In these fabrics, a much higher aspect ratio, usually above 10:1, is used, or example in carpet backing (U.K. Patent 1,362,684 assigned to Thiokol Chemical Corporation) and in geotextiles, webbing, and bulk containers (Langston et al., U.S. Pat. No. 4,643,119), in a woven fabric using a fiber-reinforced flat tape as both warp and weft, and intended for use as a plastics reinforcement (Binnersley et al., U.S. Pat. No. 4,816,327) and in a sail cloth (Mahr, U.S. Pat. No. 4,590,121). It has also been proposed to use a flattened monofilament in a woven filter fabric intended to be used for sludge dewatering (E.P. 0 273 892, assigned to Scandiafelt AB).

It has also been proposed to dewater a paper web in a press section using a fabric to which no batt is attached. Such a procedure is described by Kufferath, in West German Patent 3,426,264. However, it has been found that the dewatering fabric described by Kufferath is only successful when making thicker grades of paper.

The key feature of the Miller et al. press felt is the use in the base fabric of a flattened monofilament. It has now been discovered that similar flattened monofilaments can be used to provide an improved press dewatering fabric offering both improvements in web dewatering and resistance to paper marking by either the dewatering fabric or the press roll grooves. Furthermore, the paper side batt required by Miller et al. can be omitted in some applications.

According to this invention, flattened monofilaments are used both at a high fill factor and in a weave pattern that provides a long float surface on the paper side of the fabric. These features of the dewatering fabrics of this invention appear to impart to the fabric a relatively flat, smooth, almost platform-like surface on the paper side of the fabric. This relatively flat surface appears to transfer the mechanical loads imposed by the press rolls in a way that provides improved pressure uniformity. It is also believed that the improved paper web dewatering capabilities and the resistance to paper marking shown by the fabrics of this invention may be directly related to the pressure uniformity characteristics of these fabrics under compressive loading.

Thus, in its broadest aspect, this invention provides a woven dewatering fabric for the press section of a paper making machine having opposed side edges, the fabric having a cross machine direction extending between the side edges and a machine direction extending perpendicularly to the cross-machine direction, and having a fabric weave pattern that provides long exposed floats on the paper side of the fabric of a monofilament warp yarn having a flattened cross-section with an aspect ratio of at least 1.5:1, having a fill factor for the flattened monofilament of at least 45%, and having a float ratio for the exposed floats of the flattened monofilaments expressed by the formula of a/b wherein:

(i) "a" represents the number of paper side surface layer weft yarns in a single weave pattern repeat of a flattened monofilament warp which are underneath and in contact with that warp;

(ii) "b" represents the total number of paper side surface layer weft yarns in the single weave pattern repeat;

and further wherein for a majority of the long exposed floats:

(iii) "a" is greater than 1; and (iv) "a" is greater than one half of "b".

Preferably, the fill factor for the flattened monofilaments is at least 60%. More preferably, the fill factor is at least 80%; most preferably the fill factor is about 85%.

Preferably, the dewatering fabric is of a single layer construction but the benefits of this invention can also be obtained with more complex fabrics. Preferably the float ratio for the flattened monofilaments, calculated as detailed above, is at least $\frac{5}{8}$ and more preferably is from $\frac{3}{4}$ to $\frac{7}{8}$.

Preferably the aspect ratio of the flattened monofilament is at least 1.6:1 and most preferably at least about 2:1.

If a paper side batt of staple fibers is used it is preferred that it be applied substantially perpendicularly to the flattened monofilaments. It is also contemplated that a batt layer may be applied to the roll side of the dewatering fabric.

A press dewatering fabric can be woven in several ways. It can be woven as a closed endless loop of the desired length, and which may include a pin seam. Alternatively, the fabric can be woven as a continuous run of flat fabric, a suitable length of which is then seamed, for example with a pin seam, to provide the required endless loop.

The main difference between these methods is the orientation in the woven fabric loop of the warp and weft yarns:

(a) in a fabric woven as a closed endless loop (with or without a seam), the warp yarns lie in the cross machine direction, and comprise the flattened monofilaments of this invention; and (b) in a fabric woven as a continuous run, which is seamed to provide a closed endless loop, the warp yarns are in the machine direction, and comprise the flattened monofilaments of this invention.

It is also know to flat weave a fabric in which the weft yarns are flattened monofilaments. However, special weaving and post-weaving processing techniques may be necessary to properly expose the floats of flattened monofilaments.

If the fabric is to be used in the press section with a needled batt applied either to the paper side, or to both sides of the fabric, a fabric woven as a closed endless loop is preferred. The endless loop may also include a pin seam.

If the fabric is to be used in the press section without a needled batt applied to it, as this invention contemplates, either one of the previously described weaving techniques may be employed. If the fabric is to be seamed to facilitate its installation on the paper making machine, it is advantageous to use a pin seam.

Generally, press felts are constructed from nylon monofilaments, with nylon staple fibers as the batt, although polyester and other materials have been used. It is preferred to use nylon monofilaments and staple fibers for this invention, but this invention is not limited to this material.

The invention will now be described in more detail with reference to the attached figures wherein.

Figure 4A:
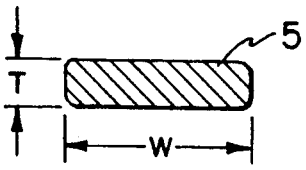
Figure 4B:
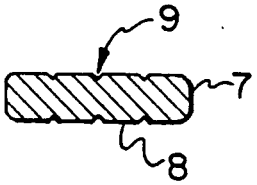
Figure 5A:
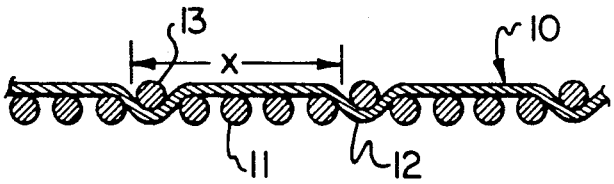
Figure 5B:
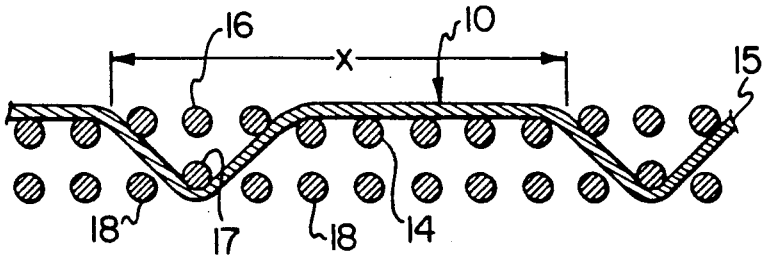
Figure 5C:
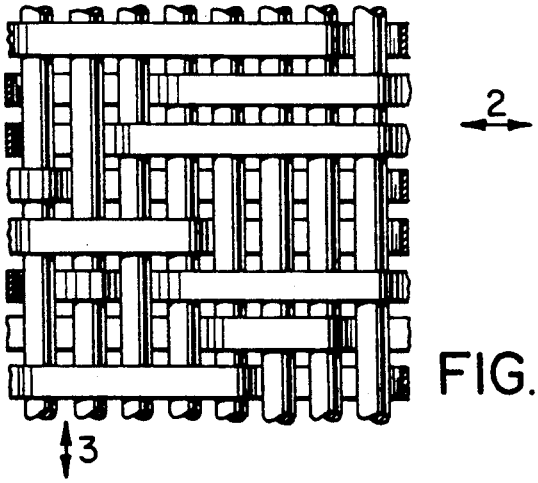
Figure 5D:
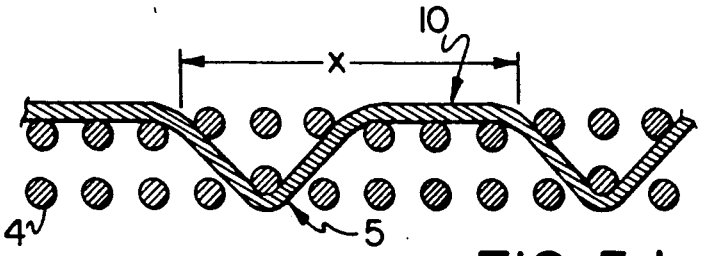
Figure 6A:
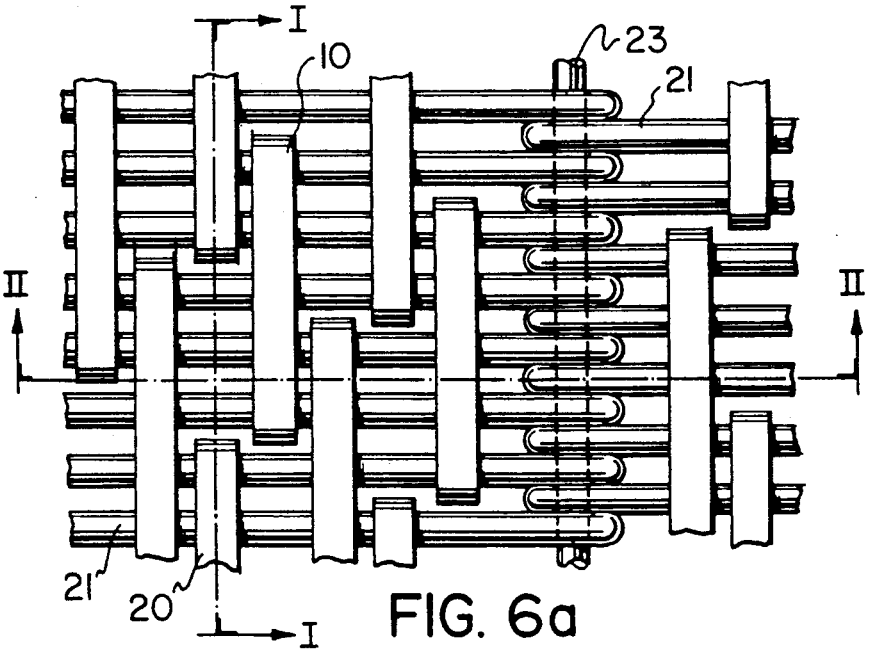
Figure 6B:
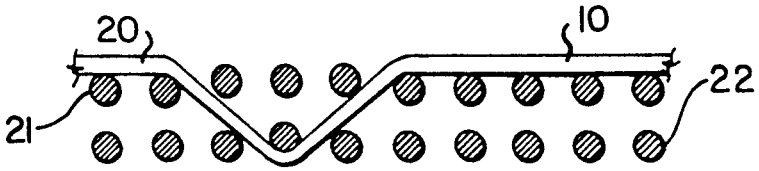
Figure 6C:
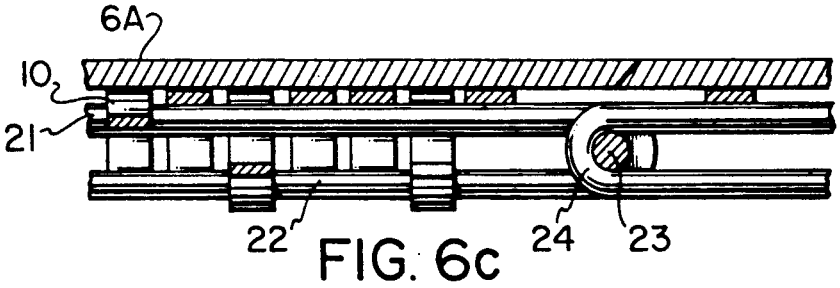
Figure 6D:
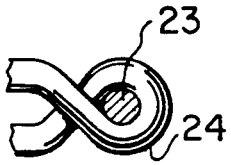
Figure 7A:
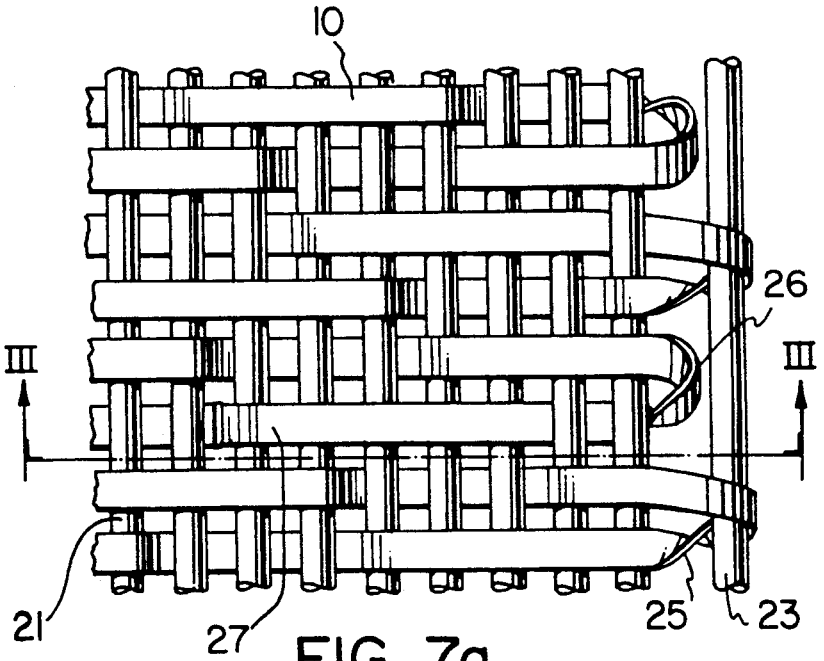
Figure 7B:
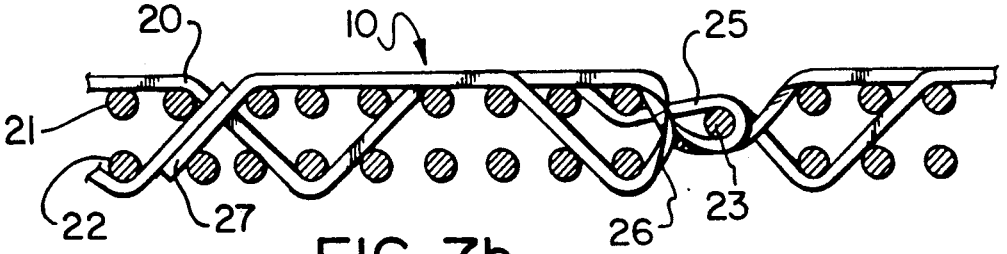
Figure 8A:
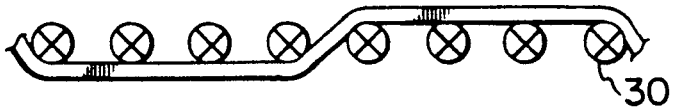
Figure 8B:
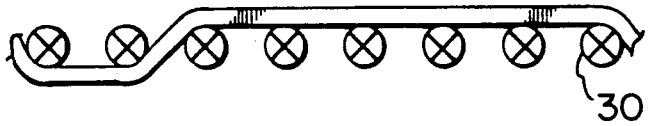
Figure 8C:
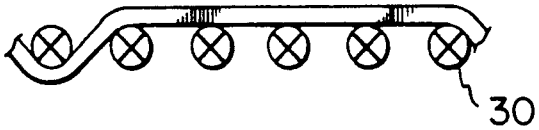
Figure 8D:
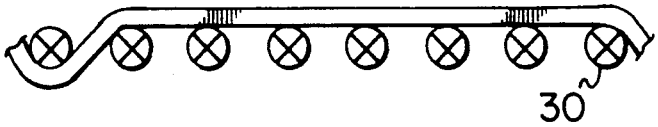
Figure 8E:
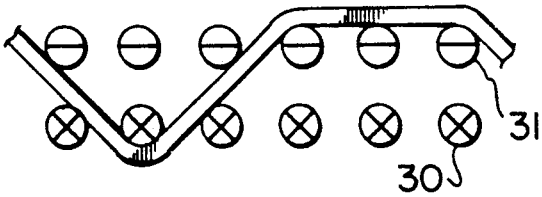
Figure 8F:
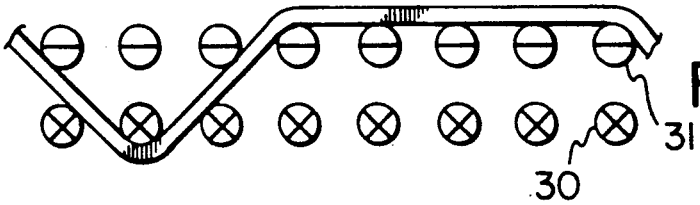

FIGS. 4*a* and 4*b* show typical flattened monofilament cross-sections;

FIGS. 5*a*, 5*b*, 5*c* and 5*d* illustrate some alternative weave patterns for single and double layer fabrics;

FIGS. 6*a*, 6*b*, 6*c*, 6*d*, 7*a* and 7*b* illustrate pin seam structures; and FIGS. 8*a*, 8*b*, 8*c*, 8*d*, 8*e* and 8*f* illustrate the weave structures used in the examples.

Figure 1:
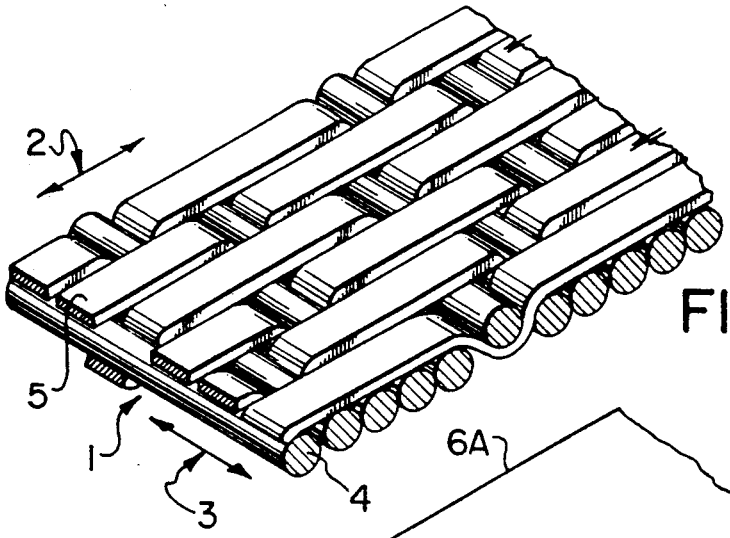
FIG. 1 shows in schematic form a dewatering fabric according to this invention.

In FIG. 1, one example of a dewatering fabric according to this invention is shown schematically, generally at 1. The arrow 2 indicates the cross-machine direction, and the arrow 3 indicates the machine direction. As shown, the fabric is thus one made as a closed loop by endless weaving. For a fabric woven as a continuous flat run, arrows 2 and 3 are interchanged: 2 becomes the machine direction and 3 becomes the cross-machine direction. In this Figure, a single layer fabric is shown comprising essentially parallel weft yarns 4 and essentially parallel flattened warp monofilaments 5. The weft yarns 4 can be any of those commonly used in such a fabric, including monofilaments, spun yarns and braided yarns.

Figure 2:
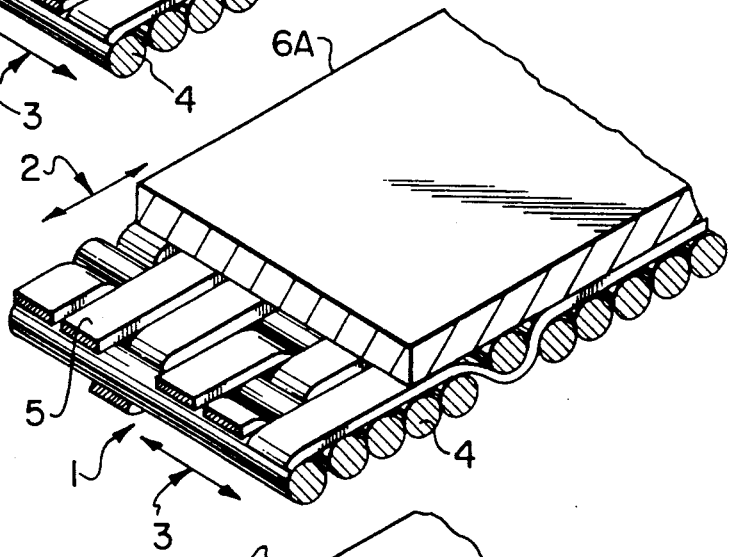
FIG. 2 shows the fabric of FIG. 1 with a paper side batt.
Figure 3:
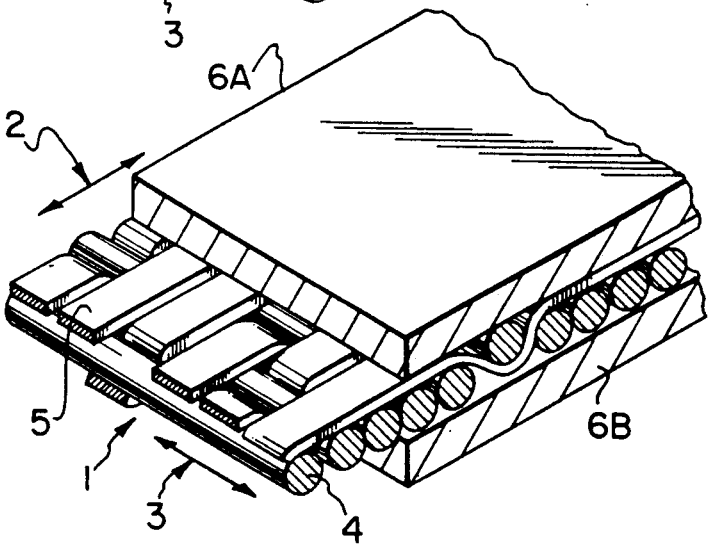
FIG. 3 shows the fabric of FIG. 1 with batts on both sides.

As is shown in FIGS. 2 and 3, porous layers, such as a needle punched fiber batt, may be attached to the fabric. A paper side batt is shown generally at 6A, and a machine side batt generally at 6B. It is preferred that a paper side batt 6A be applied substantially perpendicular to the flattened monofilament warps 5, that is, substantially parallel to the arrow 3.

As shown in FIG. 4, which represents a cross-section of the flattened filament 5, these filaments have a width W and a thickness T. The aspect ratio of such a filament is defined as the ratio W:T. For the filament shown the aspect ratio is 4:1. For the purposes of this invention, the aspect ratio should be greater than 2:1, and preferably of the order 2:1 to 20:1. If T is made too low, the filament becomes too thin and too flexible to prevent both the knuckle pattern of the weft yarns 4 and the groove, or other pattern, in the press roll from being transmitted to the paper in the press roll nip. Such marking of the paper surface is not desirable. A suitable lower limit for T appears to be at about 0.1 mm.

The lowest value for the aspect ratio is 1:1; that is, a substantially square monofilament. In the fabrics of this invention it is intended that the long exposed floats of the flattened monofilament provide something approximating to a flat surface to support the wet paper web. If the aspect ratio is made too small, it becomes difficult to create such a fabric with currently available machinery, even at the high flattened monofilament fill factors used in this invention. An undesirable degree of twisting of the flattened monofilaments appears to occur if the aspect ratio is less than about 1.3:1. In view of this, an aspect ratio of 2:1 or higher is preferred. The upper limit for the aspect ratio appears to be determined by the weaving equipment. A practical upper limit appears to be at about 100:1.

When a batt is needle punched to the dewatering fabric, many of the needles will puncture the flattened monofilaments. Even though this inherently means that the punched monofilaments are damaged, this appears to be of no consequence provided the amount of needling used is not excessive. Further, it appears that the high fill factors used herein lead to better attachment of a batt to the dewatering fabric as fewer needles fail to encounter a warp or weft yarn. Additionally, at least in part due to the high fill factor, split monofilaments tend to pinch the batt fibers and hold them in place.

It is also possible to control to some degree the point at which the needles will penetrate the flattened monofilaments. The monofilament shown generally at 7 in FIG. 4(*b*) with an aspect ratio of 4:1 has four flat faces 8 separated by three grooves 9 on each side. It is found in practice that the needles will tend to punch through in the grooves 9 rather than the faces 8 with such a monofilament.

It was noted above that the orientation of the flattened monofilaments is of importance in the context of pin seams. Due to the fact that the wefts used are of a substantially circular cross-section, in a needle punching operation few of the wefts are punctured by the needles: in most cases the weft is simply deflected a little sideways by the needle. It is therefore advantageous to form the pin seam from the undamaged weft yarns. Since the wefts are in the machine direction in a fabric woven as a closed loop, it is preferred to use such a fabric if a batt is to be applied. Alternatively, if no batt is to be used, then it may be advantageous to form the pin seam using the flattened monofilament warp yarns.

In FIGS. 5, 6(*b*), 7(*b*) and 8 are shown diagrammatic cross-sections for various possible dewatering fabric constructions, of which three, as is discussed in more detail below, are outside the scope of this invention (FIGS. 5(*d*), 8(*a*) and 8(*e*)) and are given for comparison purposes.

Two features of the dewatering fabrics of this invention are particularly important, one of which is shown in these diagrams. One is the "float ratio", the other is the "fill factor".

The float ratio represents the proportion of a flattened monofilament warp which provides a long, exposed float on the paper side of the fabric, as at 10 in this group of Figures. The float ratio is expressed as a "ratio" a/b in which a and b are integers, and (i) "a" represents the number of paper side surface layer weft yarns in a single weave pattern repeat of a flattened monofilament warp which are underneath and in contact with that warp; and (ii) "b" represents the total number of paper side surface layer weft yarns in the surface of the fabric in the pattern repeat.

For such an exposed float to satisfy the requirements of this invention the observed float ratio must satisfy two further limitations:

(iii) "a" is greater than 1; and (iv) "a" is greater than one half of "b".

Applying these principles first to FIG. 5 gives the following float ratios for FIGS. 5(*a*), (*b*) and (*d*):

for FIG. 5(*a*): a=4, b=5, and the float ratio is 4/5: the group of four wefts 11 is beneath and in contact with the warp 12, and there is one additional weft 13 in the repeat pattern X.

for FIG. 5(*b*): a=5, b=8, and the float ratio is 5/8: only the five wefts 14 under warp 15 and the three wefts 16 above warp 15 are counted; the weft 17 although above, and the seven wefts 18 although below are not in the surface layer and are not counted in determining either a or b.

for FIG. 5(*d*): a=3, b=6, and the float ratio is 3/6 and thus outside the scope of this invention, since the subsurface layer is not counted.

In a similar fashion, float ratios are calculable for all of the remaining diagrams:

FIG. 6(*b*): a=5, b=8: float ratio: 5/8;
FIG. 8(*a*): a=4, b=8: float ratio: 4/8 (comparison);
FIG. 8(*b*): a=6, b=8: float ratio: 6/8;
FIG. 8(*c*): a=5, b=6: float ratio: 5/6;
FIG. 8(*d*): a=7, b=8: float ratio: 7/8;
FIG. 8(*e*): a=3, b=6: float ratio: 3/6 (comparison);
FIG. 8(*f*): a=5, b=8: float ratio: 5/8.

The float ratio in a given fabric need not be constant either along a given flattened monofilament, or for all of the monofilaments in a given weave. Further, not all of the exposed floats need have a float ratio in accordance with the limitations placed on a and b in this invention, although maximum benefit will be obtained if all of the flattened monofilaments do have a float ratio in accordance with those limitations. FIG. 5(*c*) shows a fabric with varying float ratios: from the top downwards the float ratios are: $\frac{7}{8}$, $\frac{5}{8}$, 6/8, $\frac{1}{8}$, 4/8, 6/8, $\frac{3}{8}$ and $\frac{5}{8}$. In a similar way, it is also possible to change the float length periodically along the length of the warps, to provide, for example, in sequence a ½ unit, and then a 5/6 unit. In such a case, for determining the float ratio the overall length of the full pattern repeat should be used: the preceding example gives a float ratio of 6/8. However, as the proportion of the flattened monofilament warps woven with float ratios in which both a and b are small numbers, or in which a is close to one half of b, then the dewatering properties of the fabric will be impaired, and the risk of the fabric imparting knuckle marks to the paper will increase.

It is also possible to include in the dewatering fabric warps which are not flattened monofilaments. This is not recommended, as the dewatering capabilities of the fabric will likely be impaired, and increase the risk of paper marking.

There is however a limit to the float factor beyond which fabric structural integrity becomes questionable. In view of the varieties of weave possible it is difficult to be precise. For a simple fabric as shown in FIGS. 1 and 5(*a*) this structural limitation appears to be reached at a float factor of about 9/10. A float factor of ⅞ appears to be a suitable practical limit.

The fill factor expresses essentially just how much of the space in the fabric is taken up by the yarns from which it is constructed It can be measured for both the warp and the weft yarns. It is given by:

$$\text{fill factor } \% = \frac{N \times W}{D} \times 100$$

where:

(i) N is the number of yarns in a given distance D; and (ii) W is the maximum lateral width of the yarn.

In this formula N is also known as the yarn count.

For a yarn of essentially circular cross-section, for example as used in the wefts of FIG. 1, W is the yarn diameter. For the flattened monofilaments, W is the monofilament width as indicated in FIG. 4(*a*). Both D and W are measured in the same units. For the purposes of this invention, the fill factor for the flattened monofilaments should be above 45%, preferably at least 60%, and more preferably is about 80%, with a value of 85% being most preferred. As noted earlier, this high fill factor aids in batt retention when these are used.

For the other yarns, the yarn count, N, to a degree determines the amount of support provided to the long exposed floats. These need to be supported enough to substantially prevent them from sagging under the pressure applied to the dewatering fabric in the press roll nip. If the flattened monofilaments in a warp are relatively thick, have a high fill factor, and the press roll line pressure is relatively low, then the weft yarn count can be decreased. Generally, it is found that the yarn count should be relatively high for the yarns other than the flattened monofilaments.

The previously described advantages of increased dewatering capability are also realized in pin-seamed fabrics that are woven either as closed loops or continuous runs.

Typical pin seams of largely conventional construction are shown in FIGS. 6 and 7. In FIG. 6 the fabric is one woven as a closed loop, with the exposed warp floats 10 in the cross machine direction. In FIG. 7 the fabric is one woven as a continuous flat run, with the exposed warp floats 10 in the machine direction. In FIG. 6 the batt 6A is shown only in FIG. 6(*c*) for clarity. Referring first to FIG. 6, the fabric shown in face view in FIG. 6(*a*) is shown in section along the lines I—I in FIG. 6(*b*), and along the lines II—II in FIG. 6(*c*). The fabric, which has a float ratio of ⅝, comprises flattened warps 20, two layers of wefts 21 and 22, a single surface batt 6A, and a pin seam pin 23. The pin seam is constructed by providing loops as at 24 in the weft yarns which may be a plain bend (FIG. 6(*c*)) or a more or less complete loop (FIG. 6(*d*)). When prepared for installation on the paper making machine, the pin is removed, the fabric is fed through the press section, and the loop is closed by reinterdigitating the fabric butt end loops and reinserting the pin.

In FIG. 7 the construction is substantially the same. The fabric weave is essentially the same, including flattened monofilament warps 20, two layers of wefts 21 and 22, and a pin seam pin 23. For clarity only one side of the seam is shown in FIG. 7(*a*). In creating the seam essentially the same procedure is used, however in this case allowance has to be made for the fact that the crimped flattened monofilaments are forming the loops of the pin seam. Accordingly, it is desirable to incorporate a twist in the warps used to make the loops, as at 25, and in those woven back into the fabric ends but not used to provide loops, as at 26. In this way, the warp end 27 can be re-entered into the weave to form an overlapped joint in a fashion that is well known in the art, since it will then be crimped to fit the existing weave pattern.

The flattened monofilaments in either configuration provide a surface that offers excellent paper side batt adherence, possibly eliminating the need for a machine side batt. This is because the flat monofilaments split when needled, trapping the batt fibers and anchoring them in the base fabric. Flattened monofilaments reduce paper marking because the warp and weft cross-over points are not as prominent as those formed of all-round monofilaments. Pin-seamed fabrics woven according to the invention are also more resistant to diagonal distortion because the area of contact between the flat and round monofilaments at cross-overs is greater than that found at cross-overs of two round yarns.

In order to establish the float ratio lower limits, comparative tests were made, using single layer and double layer weaves, at various float ratios. Changes in the consistency of the paper as it passes through the press section are used as a measure of water removal efficiency. "Consistency" is defined as the percentage of dry paper solids (fibers, fillers, and so forth) in the wet paper web. A typical consistency entering a press section is 22%. In the last pressure nip of a press section, the exiting consistency will typically be from about 38% to about 41%.

The effect of float ratio on water removal was tested using a laboratory press, and following generally the technique described by Jackson, *Tappi Journal*, 72(9), 103–107. This laboratory procedure appears to give a good relative indication of press felt performance. In Table I is given the data for four single layer felts with the same nominal batt design and weft type, but differing float ratios. In Table II similar data is given for two double layer felts. The weave patterns are shown diagrammatically in FIG. 8. In these Figures, the wefts 30 are 6-strand cabled monofilaments, and the wefts 31 are multifilament yarns.

TABLE I

| Weft: 0.2 mm/2/3 cabled monofilament; woven at a pitch of 1.1 mm<br>Warp: 0.2 mm by 0.4 mm without grooves; fill factor: 80% | | | |
|---|---|---|---|
| No. | Weave Pattern in FIG. 8 | Float Ratio | Consistency after Pressing |
| MA3 | (a) | 4/8 (0.5) | 53.3% |
| MA2 | (b) | 6/8 (0.75) | 54.2% |
| MA26 | (c) | 5/6 (0.83) | 55.6% |
| MA1 | (d) | 7/8 (0.875) | 55.9% |

TABLE II

| Weft: upper layer (31): 350 tex multifilaments; woven at a pitch of 1.1 mm<br>lower layer (30): as in Table I<br>Warp: 0.2 by 0.4 mm without grooves; fill factor: 80% | | | |
|---|---|---|---|
| No. | Weave Pattern in FIG. 8 | Float Ratio | Consistency after Pressing |
| MA25 | (e) | 3/6 (0.50) | 56.1 |
| MA15 | (f) | 5/8 (0.625) | 56.9 |

For each set of tests, the ingoing consistency of the paper was 35%. The data for MA3 and MA25 is included for comparison purposes. In each case, the float ratio is one in which a is one half of b, and thus is outside this invention.

These results show clearly that as both a and b increase, and as a approaches b, water removal is improved. In the paper making industry, a 1% increase in consistency is generally considered to be industrially significant.

It has been noted above that the woven dewatering fabric of this invention may not require a porous structure such as a batt on the paper side surface. If a batt is used, some thought needs also to be given to the direction in which it is to be laid. If the dewatering fabric is an endless woven loop with flattened monofilament warps in the cross machine direction then the batt should be laid in the machine direction using, for example, the Dilo method (see U.S. Pat. No. 3,508,307). If the dewatering fabric is a flat woven fabric in which the warps are the flattened monofilaments then a cross lapped batt structure is preferred. But if the dewatering fabric is a flat woven fabric in which the wefts are the flattened monofilaments, then the batt should be preferably laid in the machine direction. Again, the Dilo method can be used.

What is claimed is:

1. A woven dewatering fabric for the press section of a paper making machine having a paper side, a machine side, opposed side edges, the fabric having a cross-machine direction extending between the side edges and a machine direction extending perpendicularly to the cross-machine direction, and having a fabric weave pattern that provides long exposed floats on the paper side of the fabric of a monofilament warp yarn having a flattened cross-section with an aspect ratio of at least 1.5:1, having a fill factor for the flattened monofilament of at least 45%, and having a float ratio for the exposed floats of the flattened monofilaments expressed by the formula of a/b wherein:

(i) "a" represents the number of paper side surface layer weft yarns in a single weave pattern repeat of a flattened monofilament warp which are underneath and in contact with that warp;

(ii) "b" represents the total number of paper side surface layer weft yarns in the single weave pattern repeat;

and further wherein for a majority of the long exposed floats:

(iii) "a" is greater than 1; and (iv) "a" is greater than one half of "b".

2. A dewatering fabric according to claim 1 wherein the woven fabric is a single layer fabric.

3. A dewatering fabric according to claim 1 wherein the woven fabric is a double layer fabric.

4. A dewatering fabric according to claim 1 additionally including a porous layer attached to the paper sides of the woven fabric.

5. A dewatering fabric according to claim 1 additionally including a porous layer attached to both sides of the woven fabric.

6. A dewatering fabric according to claim 1 additionally including a single batt of staple fibers attached to the paper side of the woven fabric.

7. A dewatering fabric according to claim 6 additionally including a single batt of staple fibers needled to the paper side of the woven fabric.

8. A dewatering fabric according to claim 1 additionally including a batt of staple fibers attached to both the paper side and the machine side of the woven fabric.

9. A dewatering fabric according to claim 8 additionally including a batt of staple fibers needled to both the paper side and the machine side of the woven fabric.

10. A dewatering fabric according to claim 7 wherein the batt of staple fibers is needled to the woven fabric and wherein the batt fibers are oriented substantially in a direction substantially perpendicular to the direction of the flattened monofilaments.

11. A dewatering fabric according to claim 7 wherein the batt of staple fibers is needled to the woven fabric and wherein the batt fibers are oriented substantially in a direction substantially parallel to the direction of the flattened monofilaments.

12. A dewatering fabric according to claim 9 wherein the paperside batt of staple fibers is needled to the woven fabric and wherein the batt fibers are oriented substantially in a direction substantially perpendicular to the direction of the flattened monofilaments.

13. A dewatering fabric according to claim 9 wherein the paper side batt of staple fibers is needled to the woven fabric and wherein the batt fibers are oriented substantially in a direction substantially parallel to the direction of the flattened monofilaments.

14. A dewatering fabric according to claim 1 wherein in the woven fabric the float ratio is from $\frac{5}{6}$ to 9/10.

15. A dewatering fabric according to claim 1 wherein in the woven fabric the float ratio is from $\frac{3}{4}$ to $\frac{7}{8}$.

16. A dewatering fabric according to claim 1 wherein the fill factor for the flattened monofilaments at least 60%.

17. A dewatering fabric according to claim 1 wherein the fill factor for the flattened monofilaments at least 80%.

18. A dewatering fabric according to claim 1 wherein the fill factor for the flattened monofilaments is about 85%.

19. A dewatering fabric according to claim 1 wherein the aspect ratio for the flattened monofilaments is at least about 2:1.

20. A dewatering fabric according to claim 1 wherein the aspect ratio for the flattened monofilaments is in the range of from about 4:1 to less than 10:1.

21. A dewatering fabric according to claim 1 wherein the woven fabric is a closed endless loop in which the long exposed floats of flattened monofilament warps are oriented in the cross-machine direction.

22. A dewatering fabric according to claim 21 which includes a pin seam.

23. A dewatering fabric according to claim 1 wherein the woven fabric is a continuous run in which the long exposed floats of flattened monofilament warps are oriented in the machine direction.

24. A dewatering fabric according to claim 23 which includes a pin seam.

25. A dewatering fabric according to claim 1 wherein a majority of the exposed yarns on the paper side of the fabric are flattened monofilaments.

26. A dewatering fabric according to claim 1 wherein substantially all of the exposed yarns on the paper side of the fabric are flattened monofilaments.

27. A dewatering fabric according to claim 1 wherein all of the exposed yarns on the paper side of the fabric are flattened monofilaments.

28. A dewatering fabric according to claim 1 wherein substantially all of the long exposed floats of flattened monofilament warps have a float ratio wherein a is greater than 1, and a is greater than one half of b.

29. A dewatering fabric according to claim 1 wherein the float ratio is not constant in the machine direction of the fabric.

30. A dewatering fabric according to claim 1 wherein the float ratio is not constant in the cross-machine direction of the fabric.

31. A dewatering fabric according to claim 1 wherein the float ratio is not constant in both the machine and the cross-machine directions of the fabric.

* * * * *